US005224603A

United States Patent [19]

Hanana et al.

[11] Patent Number: 5,224,603

[45] Date of Patent: Jul. 6, 1993

[54] APPARATUS FOR TREATING FIBER SUSPENSION

[75] Inventors: Karim Hanana; Risto Ljokkoi, both of Karhula, Finland

[73] Assignee: A. Ahlstrom Corporation, Noormarkku, Finland

[21] Appl. No.: 825,196

[22] Filed: Jan. 24, 1992

[30] Foreign Application Priority Data

Jan. 30, 1991 [FI] Finland ..... 910437

[51] Int. Cl.[5] ..... B07B 1/22

[52] U.S. Cl. ..... 209/270; 209/273; 209/380; 210/415

[58] Field of Search ..... 209/17, 270, 273, 306, 209/380; 210/415

[56] References Cited

U.S. PATENT DOCUMENTS

| | | | |
|---|---|---|---|
| 3,363,759 | 1/1968 | Clarke-Pounder | 209/273 |
| 3,437,204 | 4/1969 | Clarke-Pounder | 209/273 |
| 3,726,401 | 4/1973 | Bolton, III et al. | 209/273 X |
| 3,912,622 | 10/1975 | Bolton, III et al. | 209/273 X |
| 3,939,065 | 2/1976 | Einarsson Ahlfors | 209/240 |
| 4,188,286 | 2/1980 | Holz | 209/273 |
| 4,193,865 | 3/1980 | Aario | 209/240 |
| 4,202,761 | 5/1980 | Holz | 209/17 |
| 4,601,819 | 7/1986 | Pelhammer et al. | 209/273 |
| 4,634,521 | 1/1987 | Simola et al. | 209/17 |
| 5,000,842 | 3/1991 | Ljokkoi | 209/273 |
| 5,102,532 | 4/1992 | Hautala et al. | 209/273 |
| 5,147,543 | 9/1992 | Frejborg | 209/273 |
| 5,172,813 | 12/1992 | Ljokkoi | 209/273 |
| 5,176,261 | 1/1993 | Holz | 209/273 |

FOREIGN PATENT DOCUMENTS

| | | |
|---|---|---|
| 0289020 | 11/1988 | European Pat. Off. . |
| 42661 | 6/1970 | Finland . |
| 51719 | 11/1976 | Finland . |
| 56715 | 11/1979 | Finland . |

*Primary Examiner*—Robert P. Olszewski
*Assistant Examiner*—Steven M. Reiss
*Attorney, Agent, or Firm*—Nixon & Vanderhye

[57] ABSTRACT

An apparatus and method for treating fiber suspension is especially applicable for pulp screening in the wood processing industry, particularly for the separation of light particles from fiber suspensions. The apparatus comprises an outer casing with conduits for inlet pulp, accepts, heavier rejects and lighter rejects; a filter cylinder and a rotor, the surface of which is provided with at least one protrusion; and an opening for guiding the light rejects through the surface of the rotor.

18 Claims, 2 Drawing Sheets

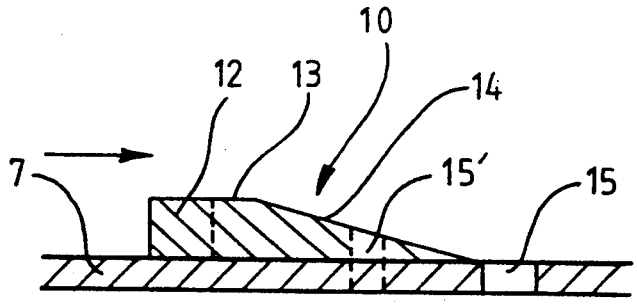
FIG. 2
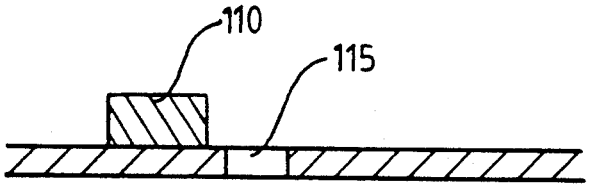
FIG. 3
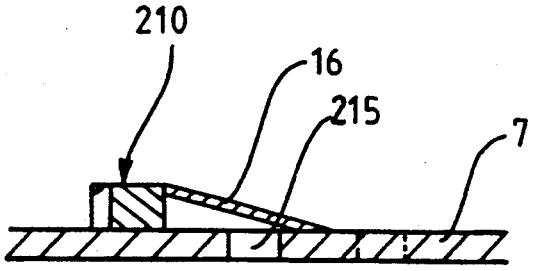
FIG. 4a
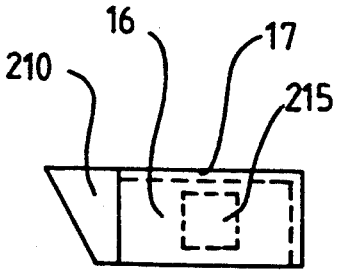
4 b

APPARATUS FOR TREATING FIBER SUSPENSION

BACKGROUND & SUMMARY OF THE INVENTION

The present invention relates to an apparatus for treating fiber suspension. The apparatus in accordance with the present invention is especially applicable for pulp screening in the wood processing industry and especially for the separation of light particles from the fiber suspensions. Moreover, the invention relates to a rotor structure of the screener.

There are in principle two known rotor types, which both are in common use and the purpose of which, as known, is to maintain the filter surface clean, in other words to prevent the formation of fiber matting on the filter surface. One of the rotor types may be exemplified by a rotor in accordance with U.S. Pat. No. 4,193,865, in which a rotatable rotor has been arranged inside a cylindrical, stationary filter cylinder and which rotor comprises blades which are positioned close to the surface of the filter cylinder, and which blades in the construction of the example are in an angle position relative to the shaft of the cylinder. The filter surface is subjected to pressure pulses by the moving blades, which thus clear the openings of the surface. There are also embodiments, in which the blades are located on both sides of the filter cylinder. At this point the suspension to be treated is introduced to the inside or the outside of the cylinder and the discharge of the accept is from the outside or the inside of the cylinder, respectively.

The other type is exemplified by a rotor in accordance with U.S. Pat. No. 3,437,204, in which the rotor is substantially a closed cylindrical object, the surface of which is provided with almost hemispherical protrusions. When this type of apparatus is used pulp is supplied to a treatment volume between the rotor cylinder and the filter cylinder outside the rotor cylinder, whereby the purpose of the protrusions from the rotor is both to press the pulp against the filter cylinder and to draw (with the trailing edge) the thickened fiber matting off from the openings of the filter cylinder. Because this kind of a construction has a highly thickening effect on the pulp, three dilution water conduits have been mounted at different levels in the filter cylinder in the structure in accordance with this patent, so as to carry out the screening of fiber suspension satisfactorily. A "bump rotor" is also illustrated in U.S. Pat. No. 3,363,759, in which the rotor is slightly conical.

Moreover, there are other embodiments of the above-mentioned cylindrical rotor, which are illustrated in different publications with different protrusions on the filter cylinder side.

U.S. Pat. No. 4,356,085 discloses a knotter, which has plough-like protrusions of plate material on the surface of the cylindrical rotor cylinder, which are used to bring about strong mixing forces in the pulp between the rotor and the filter cylinder so that the fibers would pass the filter cylinder as effectively as possible and the knots, shives and like would separate.

U.S. Pat. Nos. 4,188,286 and 4,202,761 disclose a filter apparatus, which has a rotatable cylindrical rotor inside the filter cylinder. The rotor surface on the filter cylinder side is provided with protrusions having a wedge-like radial cross-section in such a way that they have a front surface evenly rising from the rotor surface, a surface parallel to the rim of the rotor and extending closest to the filter cylinder and a rear surface substantially perpendicular against the rotor surface. These protrusions are arranged on the surface of the rotor cylinder at a particular angle position relative to the axial direction so that all the protrusions of the rotor are at the same position relative to the axis of the rotor.

When the pulp is supplied to outside of the filter cylinder and the accept is discharged from the inside of the filter cylinder, in other words on the rotor side, the rotational direction of the rotor is such that the angular position of the protrusions subjects the accepts to a downward force component and the inclined/rising surface operates as a front surface. In U.S. Pat. No. 4,188,286 the rotor surface is provided with openings which are located in the flow direction behind the protrusions, and through which accepts pulp which has been screened through the screen is discharged to the accept conduit of the apparatus from between the screen and the rotor. The openings of the rotor surface are thus used for the discharge of accepts, providing an in-flow-type screener.

Experiments have proven that the previously described apparatus embodiments do not operate satisfactorily in all fields of application. For example, the first described blade rotor causes pressure pulses that one too strong on the accepts side of the filter cylinder, so that such a structure cannot be used with the head boxes in paper machines, which should not have fluctuation of pressure in the suspension. The apparatus also tends to dilute the accepts, which is why the blade rotor cannot be applied in places where pulp of uniform consistency is required. Since the number of the blades in the blade rotor is small (4 to 8 blades), fiber matting is always formed on the filter cylinder before the next blade wipes it off. Thus the use of the filter is not efficient. Also, this rotor type is expensive to manufacture due to required exact shapes and careful finishing.

The substantially cylindrical rotor provided with almost hemispherical protrusions, described above, is eminently suited for some applications. However, the head box of a paper machine is not one of them, because the pulp suspension arriving at the head box must have a uniform consistency and size of fibers, and the machine screen should not change these values. This kind of a "bump rotor" tends to dilute the accepts and also causes fluctuation in the consistency. In performed experiments it was discovered that one of the described rotor types diluted the accepts within the range of −0.15 to −0.45%, the desired accept consistency being 3%. A consistency fluctuation, as mentioned, of +/−0.5%, is too much when aiming at a uniform and qualified final product. On the other hand, in a filter including a "bump rotor" fractionation also takes place (in other words, the interrelation of the fractions in the fiber suspension is not the same as that of the originally supplied pulp). With the "bump rotor" the change grade of fractionation varies from 5 to 10% according to the clearance between the filter cylinder and the rotor. A change grade for a blade rotor is about 20%, so a bump rotor is a considerable improvement.

The deficiencies of a filter apparatus provided with a "bump rotor" have led to some attempts for improvement, of which examples are the above-mentioned bringing of the dilution water to the filter surface, and in providing a slight conical form of the rotor.

The method in accordance with U.S. Pat. No. 5,000,842 (the disclosure of which is incorporated by reference herein) and the apparatus developed for realizing it represent the most recent developments. The method in accordance with this patent is characterized in that fiber suspension is subjected to axial forces changing in intensity and effective direction, the direction and intensity of which axial forces are determined on the basis of the axial position between the point of application and the counter surface of the filter cylinder and with which the axial speed profile of fiber suspension is changed while maintaining the flow direction constantly towards the discharge end. The apparatus in accordance with U.S. Pat. No. 5,000,842 is characterized in that at least one of the counter surfaces of the rotor and the filter cylinder towards the other is provided with at least one protrusion or the like, the direction of the front surface of which differs according to the axial direction and which subjects an axial force component to the pulp particle in the space between the counter surfaces, the intensity of which changes as a function of the axial position of the counter surfaces of a pulp particle and which changes the speed profile of the fiber suspension flowing between the counter surfaces.

Although the apparatus and method in accordance with U.S. Pat. No. 5,000,842 are superior to prior art techniques, the method described in the above-mentioned patent and the technical arrangement realizing it have further been developed. Detailed experiments have shown that all rotors using any kinds of protrusions, whether blade-like, hemispherical, rectangular or any other shape, have pulp from the top of the protrusion towards the trailing direction, the consistency and reject content of the pulp being higher than the average in the screening area. This, of course, results from the fact that the pulp has been subjected by the protrusion to a pressure stroke thus pressing acceptable material from the pulp through the filter surface, whereby both liquid and acceptable fibrous material flows through the screen surface. The experiments have also shown that thicker pulp which contains more rejects is liable to remain against the screen surface, although the effect of the rotor protrusion in the pulp portion ceases. This, of course, lowers the capacity of the screener, because fresh or less screened pulp must first pass through the pulp layer of higher consistency in order to pass through the filter. When a thickener is used the fiber matting accumulated on the filter surface requires that the filtrate must not only pass through the openings of the filter surface, but also must be pressed through the fiber matting.

The problem described above has been eliminated in U.S. application Ser. No. 07/804,534, filed Dec. 11, 1991, which is a continuation of Ser. No. 07/524,752, filed May 17, 1990, now abandoned, which has a rotor construction such that the above-mentioned thicker and coarser pulp portion is transferred away from the filter surfaces towards the rotor surface so that the fresher pulp comes into direct contact with the filter surface, whereby the deficiencies of the prior art apparatuses may be eliminated. The apparatus in accordance with this U.S. application is characterized in that the counter member of the filter surface is equipped with at least one guiding plate, which guides the enriched coarser and/or thicker suspension away from the vicinity of the filter surface.

Another embodiment of the apparatus in accordance with the above-mentioned U.S. application is characterized in that the counter surface of the filter surface is provided with at least one member, which is formed by a protrusion formed on the counter surface and a guiding plate extending from the counter surface higher than said protrusion, which protrusion and guiding plate leave between them an opening, through which the thicker and/or coarser fraction may flow under the guiding plate.

When performing test drives with these devices, it became apparent that light reject had accumulated under the guiding plate located in the flow direction behind the protrusion and descending towards the surface of the counter plate, in other words they were plastics particles, which had practically speaking filled the entire space between the guiding plate and the counter plate. When this was studied more closely it was seen that an area of reduced pressure was generated behind to the discharge side of the protrusion and especially under the guiding plate, where light particles easily accumulate while the centrifugal force moves heavier particles, such as knots and shives, etc. towards the screen surface. Thus by providing the discharge side of the protrusion or the guiding plate with openings, it is possible to remove the light reject directly to the inside of the rotor, from where they may be discharged according to the technique known from U.S. Pat. No. 4,634,521. Prior to the present invention the light rejects have accumulated on the rotor surface and drifted with the pulp flow to the lower end of the rotor, from where they have been able to turn around the periphery of the rotor to the inside of the rotor, and from where it is easy to be discharged with an apparatus according to U.S. Pat. No. 4,634,521 (the disclosure of which is incorporated by reference herein).

The apparatus in accordance with the present invention is characterized in that at least one of the protrusions on the rotor surface is provided with an opening for guiding the light reject through the rotor surface, and is seen from the following specifications and claims.

BRIEF DESCRIPTION OF THE DRAWINGS

FIG. 2 is a schematic side view of a protrusion in the rotor of FIG. 1, and the discharge opening for light rejects in accordance with the present invention arranged with the protrusion; and FIGS. 3, **4*a* and 4*b* are schematic side illustrations of different embodiments of a surface of a rotor the present invention utilizable with the apparatus of FIG. 1**.

DETAILED DESCRIPTION OF THE DRAWINGS

Figure 1:
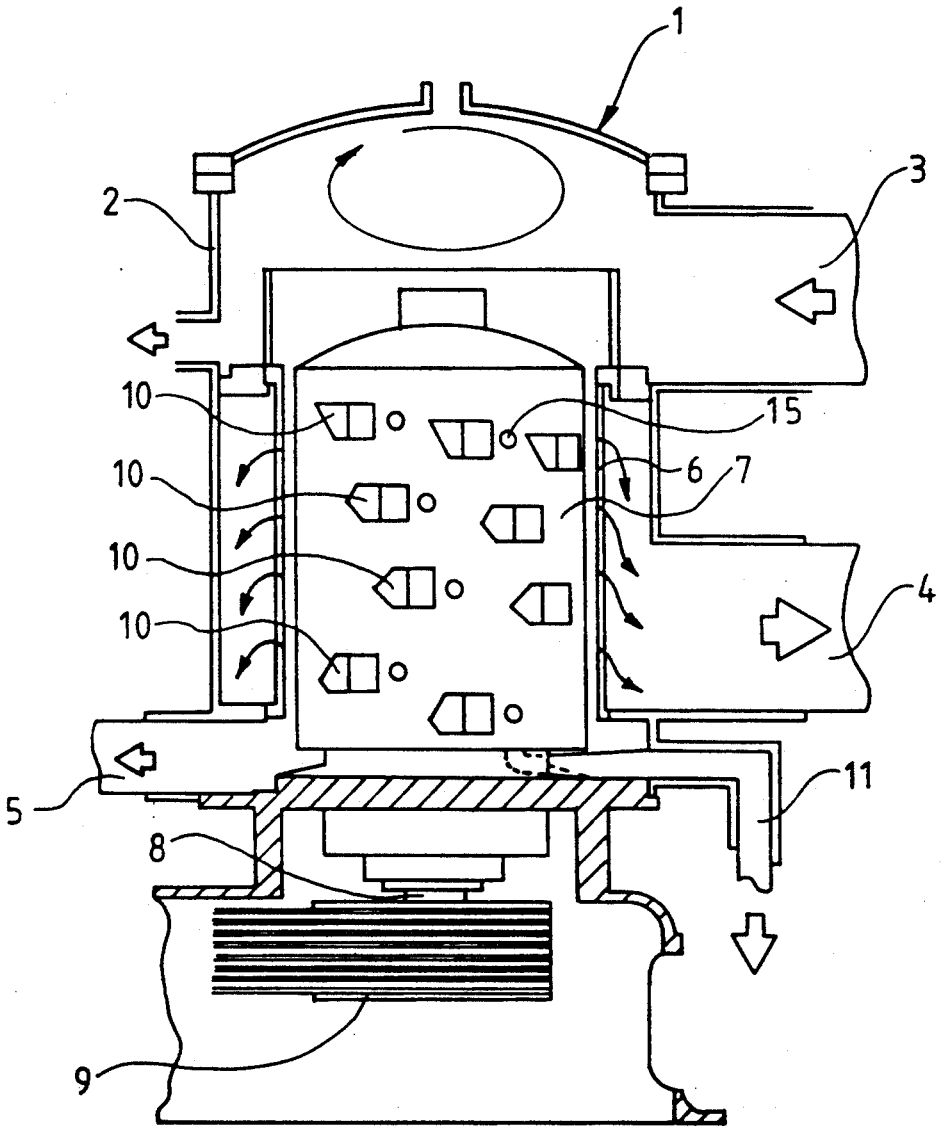
FIG. 1 is a schematic illustration of a screen apparatus primarily in accordance with an embodiment of U.S. application Ser. No. 07/804,534, filed Dec. 11, 1991, which is a continuation of Ser. No. 07/524,752, filed May 17, 1990, now abandoned, with a discharge conduit for light rejects in accordance with U.S. Pat. No. 4,634,521, and openings on the rotor surface in accordance with the present invention.

As illustrated in FIG. 1, a filter apparatus 1 in accordance with an embodiment of the present invention comprises the following components: an outer casing 2, with conduits for inlet pulp 3, accepts 4, heavier rejects 5, and lighter rejects 11 therein, a stationary screen cylinder 6, and a substantially cylindrical or possibly conical rotor 7. A shaft 8 of the rotor is conntected to driving means 9. The screen cylinder 6 may be in principle of any known type, but the best results are achieved in most cases if a grooved filter cylinder in accordance with U.S. Pat. No. 4,529,520 is used.

The apparatus of FIG. 1 mainly operates in such a way that fiber suspension is introduced from conduit 3 to the treatment volume between the screen cylinder 6 and rotor 7. The accepts, which have flowed from the openings of the screen cylinder 6 radially outwards from the rotor 7, are discharged through the accepts conduit 4, while the heavier rejects are discharged through heavier rejects conduit 5. It is appreciated from FIG. 1 that the surface of the rotor 7 on the side of the screen cylinder 6 is provided with members 10, the shape of which may vary, for example, as shown in U.S. Pat. No. 5,000,842, according to in which area (i.e., which axial part of the rotor) they are located. In a separation for light rejects in accordance with U.S. Pat. No. 4,634,521, light rejects were allowed to accumulate on the rotor surface, from which they flowed downwardly and through the bottom periphery of the rotor to the inside of the rotor, from the upper part of which the light rejects are guided through conduit 11 out of the apparatus. According to the invention the surface of the rotor 7 behind members 10 has been provided with means defining openings 15 for guiding the light reject to the inside of the rotor, from where they is discharged in a manner described in U.S. Pat. No. 4,634,521.

FIG. 2 illustrates a fragment of the surface of the rotor 7 provided with a protrusion 10. The protrusion 10 causes (in addition to other force effects depending on the shape of its front surface 12 and its direction) a pressure stroke directed towards the filter surface, which always intensifies the pulp treatment and, due to which effect the acceptable fibrous material and liquid are pressed through the filter and a zone of coarser and to some extent thickened material is formed on the surface of the filter. The front surface 12 of the protrusion 10 described above is substantially perpendicular to the surface of the rotor 7. The front surface 12 may, of course, also be inclined in one direction or the other. The protrusion 10 may also have a portion 13 parallel to the surface of the rotor 7 and an inclined surface 14 descending against the surface of the rotor 7, which surface 14 may also be, if so required or desired, curved or undulated. The above-mentioned pressure stroke, intensifying the screening, is generated exactly at (or slightly in front of) the front surface 12 of the protrusion 10, and is intended to form an area of reduced pressure on the inclined surface 14 on the trailing side of the protrution 10. The area of reduced pressure draws the coarser and thickened material away from the close proximity of the filter surface 6. The same effect of reduced pressure also causes the accumulation of light rejects to the rear surface of the protrusion 10 or behind the protrusion 10, if the protrusion is short in the peripheral direction and without an inclined portion 14 descending towards the surface of the rotor 7. By arranging an opening 15 on the surface of the rotor 7 it is ensured that light rejects are discharged to the inside of the rotor 7 from the center part of the rotor due to the higher pressure prevailing on the inlet side of the screen. Another means defining an opening 15' (shown with broken lines) may also be provided in the inclined surface 14, if it seems that the light material tends to accumulate there. The rejects from the space 16 are discharged in a manner known from U.S. Pat. No. 4,634,521.

FIG. 3 illustrates a protrusion 10 having a shape which simulates a match box, in other words in a rectangular parallelipiped, and which subjects the screen surface 6 to a strong pressure stroke, which respectively developes a highly reduced pressure to the trailing side. The discharge opening 115 for light rejects is now located to the trailing side of the protrusion 110 to guide the light rejects to the inside of the rotor 7. The size of the discharge opening 115 may be estimated beforehand in each field of application separately according to the estimated amount of light rejects in each pulp volume to be screened. The size of the discharge opening 115 may be varied depending on the location of the opening 115 in the axial direction of the rotor 7 according to how the light rejects are supposed to behave in the screening appatus.

FIGS. 4*a* and 4*b* illustrate a protrusion 210, which simulates to some extent the embodiment in accordance with said U.S. Application Ser. No. 07/804,534, filed Dec. 11, 1991, which is a continuation of Ser. No. 07/524,752, filed May 17, 1990, now abandoned, in which the trailing side of the protrusion 210 is provided with a guiding plate 16, which descends gently towards the rotor surface 7. The guiding plate 16 may, of course, also be concave, convex, or even undulated, according to the particular field of application. Now the discharge opening 215 for light rejects is located under the guiding plate 16, where an area of reduced pressure is generated. In that area the pressure is at its lowest when the space between the guiding plate 16 and protrusion 210 is closed by a plate 17 from the infeed side, in other words usually from the upper end of the rotor 7. Another alternative for the location of a discharge opening 215' is the area on the surface of the rotor 7 behind the guiding plate 16, as shown in dotted line in FIG. 4*b*.

The invention also relates to a method of screening fiber suspensions utilizing an outer casing (2) including a rotatable element (7) therein with progressions (10) on an exterior surface of the rotatable element, the protrusions (10) having a leading surface (12) and a trailing surface (14), with means defining an opening (15, 15') through the exterior surface adjacent the trailing surface of at least some of the protrusions. The method comprises the steps of: (a) Feeding (through 3) inlet suspension into the outer case (2). (b) Rotating the rotatable element (7) about an axis of rotation so that the leading surface (12) of each protrusion (10) leads, and the trailing surface trails, an area of reduced pressure being provided adjacent the trailing surface of each protrusion. (c) Causing heavier rejects to be discharged from the outer casing through a heavier rejects outlet (5), and causing accepts to be discharged through an accepts outlet (4); and (d) causing light rejects to pass through the openings (15, 15') adjacent the trailing surface of at least some of the protrusions.

It is appreciated from the above description that the disadvantages of the prior art have been eliminated by the apparatus of the present invention, and at the same time it has been possible to raise the maximum screening capacity of the screening apparatus considerably, especially when separating light rejects. However, it must be noted that the above description includes only some of the most significant embodiments of the present invention, which are by no means given to restrict the invention from what is defined in the claims, which alone determine the scope of invention. Thus it must be borne in mind that the present invention includes protrusions of almost any possible shape on the rotor surface, which protrusions create an area of reduced pressure, at which light reject material tends to accumulate.

Thus all kinds of "bumps", ribs, blades, etc. members mounted on the rotor surface are referred to as "protrusions".

What is claimed is:

1. Apparatus for treating a fiber suspension, comprising an outer casing;

conduits connected to said outer casing, including an inlet pulp conduit, an accepts conduit, a heavier rejects conduit, and a light rejects conduit;

a screen cylinder having an exterior surface, and a rotatable rotor having an exterior surface;

means for mounting said screen cylinder and rotor within said outer casing so that said rotor is rotatable with respect to said screen cylinder;

means defining a plurality of protrusions on the exterior surface of said rotor; and means defining openings in said exterior surface of said rotor on the downstream side of said protrusions to guide light rejects through said exterior surface to said light rejects conduit.

2. Apparatus as recited in claim 1 wherein each of said protrusions comprises a front surface, a surface substantially parallel to said filter cylinder, and a surface inclined toward said rotor exterior surface; and wherein at least one of said openings is provided in said inclined surface.

3. Apparatus as recited in claim 2 wherein said inclined surface is planar.

4. Apparatus as recited in claim 1 wherein each of said protrusions comprises a front surface, a surface substantially parallel to said filter cylinder, and a surface inclined toward said rotor exterior surface; and wherein at least one of said openings is provided in said inclined surface.

5. Apparatus as recited in claim 4 wherein said inclined surface is planar.

6. Apparatus as recited in claim 1 further comprising an inclined guiding plate connected to at least one of said protrusions and extending behind it in the direction of flow of suspension; and wherein said means defining openings comprises means defining at least one opening in said rotor exterior surface under said inclined guiding plate.

7. Apparatus as recited in claim 6 wherein said inclined surface is planar.

8. Apparatus as recited in claim 6 wherein said guiding plate defines an under-guide volume beneath it; and further comprising a plate comprising a barrier closing off the infeed side of said under-guide volume.

9. A rotor for treating fiber suspensions, comprising:

an exterior surface;

means defining a plurality of protrusions on said exterior surface;

each of said protrusions comprising a front, upstream surface, a surface substantially parallel to said rotor, and a downstream surface incline, toward said rotor exterior surface; and means defining an opening through said exterior surface adjacent at least one of said inclined surfaces, remote from said front surface.

10. A rotor as recited in claim 9 wherein said inclined surface is planar.

11. A rotor as recited in claim 9 wherein at least one of said openings is provided in an inclined surface.

12. A rotor as recited in claim 9 wherein at least one of said openings is provided in said exterior surface of said rotor directly behind said inclined surface, opposite said front surface.

13. A rotor as recited in claim 9 wherein said inclined surface comprises an inclined guiding plate; and wherein said means defining at least one opening comprises means defining at least one opening in said rotor exterior surface under said inclined guiding plate.

14. A method of screening fiber suspensions utilizing an outer casing including a rotatable element therein with protrusions on an exterior surface of the rotatable element, the protrusions having a leading surface and a trailing surface, with means defining an opening through the exterior surface at or downstream of the trailing surface of at least some of the protrusions, comprising the steps of:

(a) feeding inlet suspension into the outer casing;

(b) rotating the rotatable element about an axis of rotation so that the leading surface of each protrusion leads and the trailing surface trails, an area of reduced pressure being provided at the trailing surface of each protrusion, or downstream thereof;

(c) causing heavier rejects to be discharged from the outer casing through a heavier rejects outlet, and causing accepts to be discharged through an accepts outlet; and (d) causing light rejects to pass through the openings at the trailing surface of at least some of the protrusions, or downstream thereof.

15. A method as recited in claim 14 wherein step (d) is practiced by providing an inclined surface trailing at least one protrusion, with the opening formed in the exterior surface of the rotatable element behind the inclined surface in the direction of rotation, so that the light rejects pass through the opening behind the inclined surface through the exterior surface of the rotatable element.

16. A method as recited in claim 14 wherein step (d) is practiced by providing an inclined surface trailing at least one protrusion, with the opening formed in the inclined surface, so that the light rejects pass through the opening in the inclined surface through the exterior surface of the rotatable element.

17. A method as recited in claim 14 wherein step (d) is practiced by providing an inclined guide plate trailing at least one protrusion, with the opening formed in the rotatable element external surface beneath the guide plate, so that the light rejects pass underneath the guide plate, and then through the opening.

18. A method as recited in claim 17 wherein step (d) is further practiced by closing off the infeed side to the volume beneath the guide plate so that the light rejects cannot flow directly from the infeed side into the opening.

* * * * *